US007861642B2

(12) United States Patent
Sonerud

(10) Patent No.: US 7,861,642 B2
(45) Date of Patent: Jan. 4, 2011

(54) VALVE BLOCK, TOOL ATTACHMENT, A WORKING MACHINE AND THE USE OF A VALVE BLOCK

(75) Inventor: Ake Sonerud, Hudiksvall (SE)

(73) Assignee: Oilquick AB, Hudiksvall (SE)

( * ) Notice: Subject to any disclaimer, the term of this patent is extended or adjusted under 35 U.S.C. 154(b) by 247 days.

(21) Appl. No.: 12/264,155

(22) Filed: Nov. 3, 2008

(65) Prior Publication Data

US 2009/0095365 A1 Apr. 16, 2009

Related U.S. Application Data

(63) Continuation of application No. PCT/SE2007/050322, filed on May 10, 2007.

(30) Foreign Application Priority Data

May 10, 2006 (SE) ..... 0601078

(51) Int. Cl.
*E02F 3/36* (2006.01)
*F15B 11/00* (2006.01)

(52) U.S. Cl. ..... 91/432; 414/723; 37/468

(58) Field of Classification Search ..... 91/45, 91/432, 433; 414/723; 37/468
See application file for complete search history.

(56) References Cited

U.S. PATENT DOCUMENTS 3,705,656 A * 12/1972 Hunger et al. ..... 414/723
4,208,163 A * 6/1980 Holmqvist ..... 414/723
5,333,400 A 8/1994 Sonerud
5,465,513 A 11/1995 Sonerud
6,866,467 B2 * 3/2005 Dvorak et al. ..... 414/723
2005/0129405 A1 6/2005 Hubendick
2006/0101953 A1 5/2006 Sonerud

OTHER PUBLICATIONS

International Search Report, 3 pages (Jul. 4, 2007).

* cited by examiner

*Primary Examiner*—Thomas E Lazo
(74) *Attorney, Agent, or Firm*—The Maxham Firm

(57) ABSTRACT

A valve block disposed adjacent a tool attachment of a working machine, where the tool attachment is adapted for connection to different types of hydraulically maneuvered tools or implements with the aid of a hydraulically actuated locking device. The valve block includes first port means, second port means, and third port means for connecting hydraulic lines of the working machine to hydraulic coupling elements and to the locking device respectively. The valve block includes a line system and valve means which communicate with the port means so as to fulfill at least three of the following five functions: ensuring the presence of pressure in the locking device in the event of a fracture in the hydraulic lines of the working machine; ensuring connection of the first port means with either the second port means or the third port means to obtain post-tensioning of the locking device to relieve the pressure load; and to provide pressure limitation.

11 Claims, 2 Drawing Sheets

VALVE BLOCK, TOOL ATTACHMENT, A WORKING MACHINE AND THE USE OF A VALVE BLOCK

FIELD OF THE INVENTION

According to a first aspect the present invention relates to a valve block for use with a tool attachment of a working machine, where the tool attachment is adapted for connection to different types of hydraulically maneuvered tools or implements with the aid of a hydraulically actuated locking device. According to second, third and fourth aspects the invention relates to a tool attachment, a working machine and to the use of a valve block according to the invention.

BACKGROUND OF THE INVENTION

During the last ten to fifteen years the use of tool attachment systems for the rapid change of buckets and tools with regard to excavating machines, wheel-mounted loaders, material handling machines of several different types have been a matter of course in the majority of European markets. The development of such systems has quickly advanced from simple mechanical solutions in which the driver leaves the driver's cabin and releases or locks the tool attachment mechanism with the aid of a simple movement of a lever and manually connects the working hydraulics of the tool. This solution has gradually been replaced with hydraulic solutions in which the driver is able to control a locking cylinder that actuates the attachment locking mechanism, by simply pressing a button in the driver's cabin. Although the tool is quickly connected mechanically in this latter case, it is still necessary to connect the hydraulic hoses to the hydraulic tool by hand. In recent years there have also been used fully automatic tool fastening systems. One example of such systems is described for instance in EP 483 232 and EP 602 165. In these cases mechanical and hydraulic buckets and tools are coupled and released fully automatically directly from the driver's cabin. Hydraulic hoses and electric supply lines are also coupled fully automatically in these cases.

The solutions described above apply generally to all types of tool carriers. For the sake of simplicity, however, the following text will be concentrated on the tool attachments for wheel-carried loaders.

The system solutions relating to fully automatic tool attachment solutions have become more complex and a number of sub-functions have been proposed in an endeavor to achieve fully functional solutions, namely:

a) A hose fracture function which is normally fitted directly to the locking cylinder to ensure that the locking function of the attachment will function even in the event of a hose fracture on the hydraulic hoses leading to the locking cylinder.

b) An electricity reversing function. In conjunction with the hydraulic rapid tool attachment the most usual solution applied involves the installation of an electricity reversing valve, a type 6/2 valve, in order to lend oil from the normal tool hydraulic system to the locking function of the attachment locking pistons. This magnetic valve is controlled electrically via a low voltage cable and a contact breaker in the driver's cabin. The reversing valve is normally placed on the machine, on its arm or jib, or separately on the tool attachment. By placing the valve as close as possible to the locking cylinder, it is possible to reduce the length of the hydraulic hose for the locking function. The valve is usually placed on the tool attachment, although this incurs serious mounting problems, especially in the case of smaller machines, due to the highly confined space available to this end. The extension of the hose between the valve and the locking cylinder presents another problem.

c) Post tensioning of the locking function in the above solution via the reversing valve. When the locking hydraulics is released with the aid of an el-type reversing valve the locking cylinder will not be subjected to any post-tensioning pressure when the valve is short circuited to the other function to give working hydraulics. The post tension on the locking system can thus be solved with a separate arrangement, in which a so-called bypass line that includes a check valve is drawn between tool hydraulics and the working hydraulics. See the following hydraulic diagram. This is usually solved by placing a hose loosely on the tool attachment. WO 2004/067855 describes a valve solution in respect of the quick attachment of a krans, where said post-tensioning function is included in a separate valve block. It will be noted that this block is not connected directly to the cylinder but is, instead, connected via hydraulic hoses.

d) The load is relieved automatically prior to connecting and disconnecting the tool hydraulics. This enables the pressure in the hoses leading to the tool hydraulics to be eliminated so as to enable the hydraulics to be released in the absence of pressure. This is particularly important in connection with fully automatic attachment systems, so that the seals in the quick couplings will be protected. This automatic pressure relief is normally effected on the machine by installing leakage lines from the tool hydraulics that are connected directly to a tank via a dumping valve. The dumping valve is controlled automatically from the attachment locking hydraulics and is provided with a time relay which ensures that the tool hydraulics are relieved of pressure prior to connection and disconnection.

All of these sub-functions are normally installed separately on the machine, the excavating/lifting arm or on the tool attachment. This installation is normally carried out in the aftermarket and is expensive and complicated since it is often necessary to loosen these parts individually from case to case and since these parts are tailored separately for the machine concerned. Moreover, several parts are included in the various solutions, in the form of machine suppliers, tool suppliers or attachment suppliers. In the majority of cases this will result in an obscure distribution of responsibility between the parties concerned.

SUMMARY OF THE INVENTION

Purposes of the present invention are to avoid the problems that are associated with conventional arrangements of these functions, as those problems are identified above. Embodiments of the invention address the enumerated problems with a valve block of the kind concerned, wherein the valve block includes first port means for connection to hydraulic lines of the working machine, second port means for connection to hydraulic coupling means intended for connection with hydraulic coupling means on the working equipment, and third port means for connection to the locking means, wherein the valve block also includes a line system which communicates with said port means, and valve means provided in the line system, wherein the valve means are adapted to fulfill at least three of the following functions:

a first function which ensures the presence of hydraulic pressure in the locking device in the event of a fracture or a leakage in the hydraulic lines of the working machine;

a second function by means of which the first port means can be selectively connected to either the second or the third port means;

a third function which results in post tensioning of the locking device when the first port means are connected to the second port means;

a fourth function that results in relieving the pressure load prior to connecting and disconnecting the hydraulic connection of the working machine; and a fifth function of providing pressure limitation.

As before mentioned, each of these functions is previously individually known, as are also the means for achieving those functions, although these known means have the form of separate elements for respective functions, these elements often being subsequently mounted and delivered from different suppliers.

Those drawbacks associated with the traditional design of said means are eliminated by the inventive valve block due to most of these functions being included in a single unit which may, of course, be delivered as a part of the tool attachment. The tool attachment may thus be delivered with a number of these functions already embodied thereby obviating the need for subsequent supplementation or requiring only at least less supplementation. All that is required in respect of mounting the tool attachment to the machine are two hydraulic lines and an electric cable connected to the machine.

According to a preferred embodiment of the inventive valve block, the valve members are adapted to fulfill at least four of said functions, preferably at least all of the functions.

The benefits mentioned above are thus further accentuated due to the fact that the requirement for separate solutions is further reduced. An optimal design, primarily in the case of sophisticated systems, is, of course, achieved when all of the functions are integrated in the valve block, therewith completely eliminating the requirement of a separate solution for each function.

According to another preferred embodiment, the valve block includes attachment means for attachment of the valve block to the locking device.

This enables the valve block to be readily fastened to the tool attachment, which in turn facilitates mounting of these components in a well defined fashion. Because the valve block is fastened to the locking device of the tool attachment, the need to arrange lines between valve block and tool attachment is eliminated.

According to a preferred embodiment of the invention, the valve members include a first check valve which is adapted to provide the first function. The check valve ensures in a simple manner that the hydraulic connection between the locking device and the hydraulic system of the working machine will be cut off simultaneously when the pressure in the hydraulic system decreases drastically, as a result of a fractured hose or the like, for instance.

According to another preferred embodiment of the invention, the valve members include a reversing valve which is adapted to provide the second function.

This function is achieved fully satisfactorily in an optimal manner with regard to simplicity and reliability with the aid of a reversing valve.

According to another preferred embodiment, the reversing valve is operated electro magnetically. This facilitates positive operation of the reversing valve from the driving cabin of the working machine and reduces the need of changing the mode of the valve manually.

According to another preferred embodiment of the invention, the line or conduit system in the valve block comprises at least one line which includes a check valve and which connects together the second and third port means and which is also adapted to provide the third and fourth functions.

Since each port means will normally include two ports there will be required in normal circumstances two such connecting lines that are each provided with check valves. Thus, in the case of this embodiment, two of the functions mentioned above are achieved by one and the same arrangement. Both the post tensioning function and the pressure relief function will be simple and reliable with this arrangement.

According to another preferred embodiment, the third port means include two ports which are each connected to a hydraulic line, wherein there is provided between these hydraulic lines a connecting line which includes a pressure limitation valve and which is adapted to provide the fifth function.

In normal cases it is a question of two lines and two ports for operation of the locking device, where only one is pressurized with high pressure. As a result of the connection there between and the pressure limitation valve, the pressure limitation function will be both simple and safe. Maneuvering of the reversing valve is also facilitated by such a design.

According to the second and third aspects of the invention, the object of the present invention is also achieved by providing a tool attachment with a valve block according to the present invention or with one of the preferred embodiments of the invention and by providing a working machine with such a tool attachment respectively.

According to the fourth aspect of the invention, the object of the invention is achieved by using a valve block for connecting and maneuvering a working tool.

As a result of the inventive tool attachment, the working machine and the use respectively afford benefits of a corresponding sort with respect to the inventive valve block and the preferred embodiments described above.

BRIEF DESCRIPTION OF THE DRAWING

The invention is more fully explained by the following detailed description of advantageous embodiments of the same, reference being made to the appended drawing figures, in which.

DETAILED DESCRIPTION OF THE PREFERRED EMBODIMENTS

Figure 1:
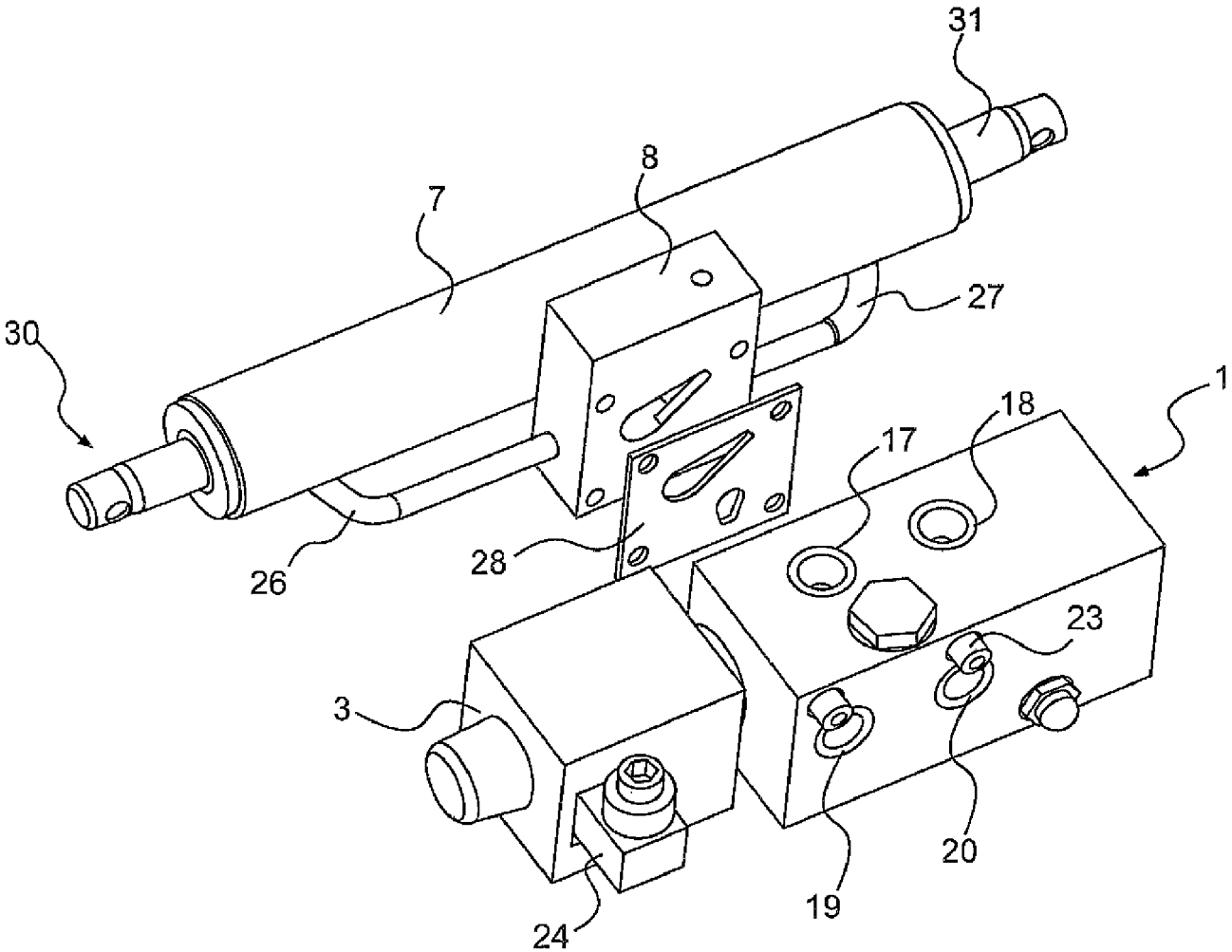
FIG. 1 shows a perspective view of a valve block according to the invention and a tool attachment locking device.

FIG. 1 is a perspective view of a valve block 1 according to the present invention. The valve block 1 is adapted so that it can be screwed firmly to a tool attachment locking device 7. The locking device is comprised of a hydraulic cylinder 7 onto which a connecting block 8 is firmly welded. The valve block 1 is intended to be screwed firmly to the connecting block of the hydraulic cylinder by means of a screw 23. A seal 28 is provided between the valve block 1 and the connecting block 8. The hydraulic cylinder 7 is mounted on a tool attachment (not shown) of a working machine and includes a piston rod 30, 31 at each end. The piston rods 30, 31 can be maneuvered between an outer and an inner position. In the outer position respective piston rods 30, 31 co-act with a locking mechanism of the working tool or implement (not shown) which is connected to the tool attachment such that the working tool will be firmly connected to the tool attachment. In the inner position of the piston rods the locking action is released so as to enable the tool to be released from the tool attachment. This type of locking mechanism is known generally and has various variants. Any closer description of this locking mechanism would therefore be superfluous in this connection.

The valve block 1 includes port means for the connection of hydraulic lines. First port means, which include the ports 17, 18, are intended for connection to hydraulic hoses on the working machine and are maneuvered from the driving cabin of the working machine. Other port means, which include the ports 19, 20, are intended for connection to hoses that are joined to female quick-couplings on the tool attachment. Third port means, which include two ports 21, 22 (obstructed in FIG. 1) are connected to the hydraulic cylinder 7 via the connecting block. The port means communicate with one another through a line system in the valve block 1, which will be described more specifically with reference to FIG. 2. There is mounted in the valve block 1 a unit which includes an electro magnet 3 for reasons described below. The electro magnet 3 is provided with a connection 24 for a cable that leads to the driving cabin of the working machine.

Figure 2:
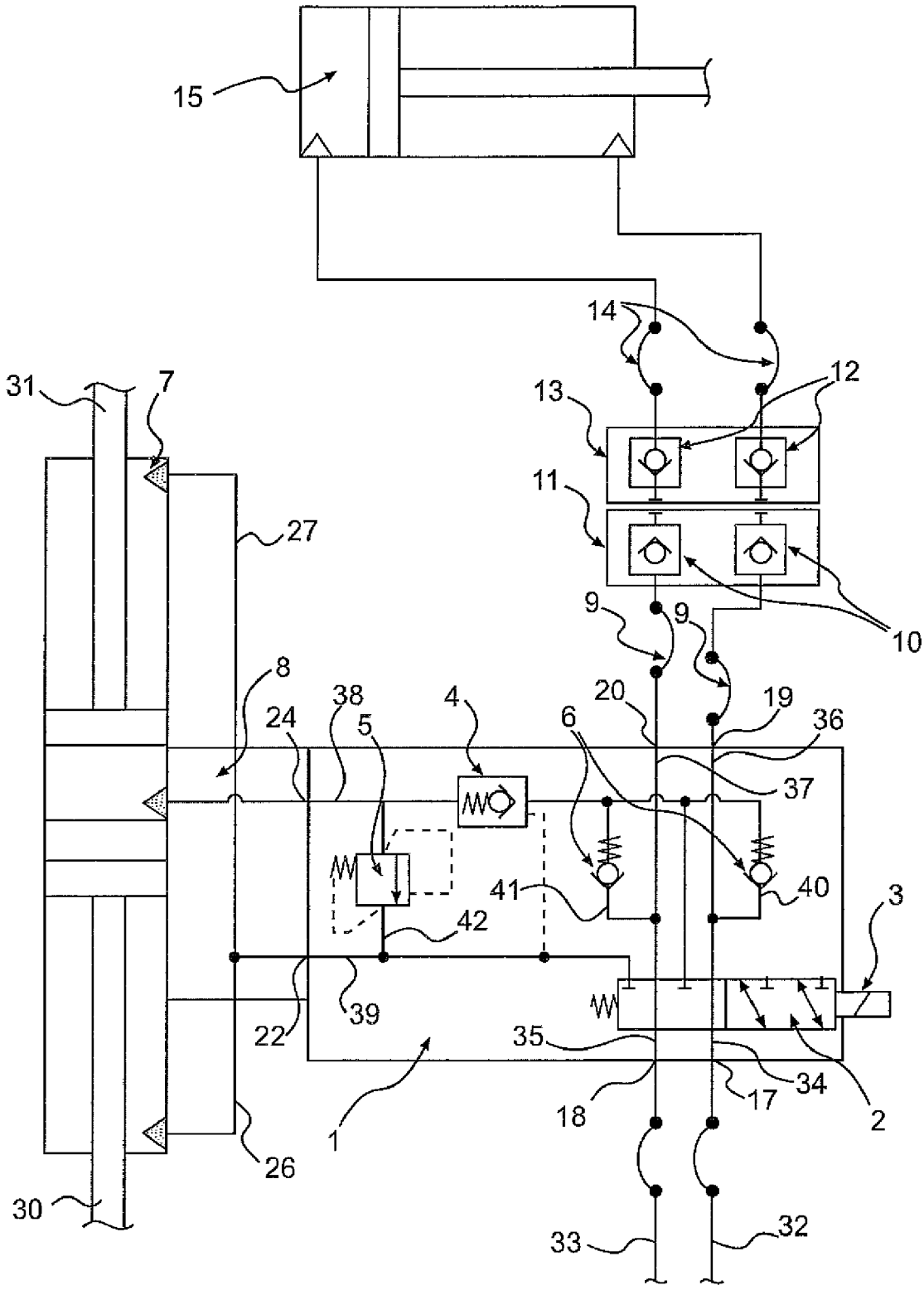
FIG. 2 shows a hydraulic circuit for the valve block of FIG. 1 and the components connected thereto.

FIG. 2 illustrates the line system within the valve block 1 and adjacent equipment. The port 17, 18 of the first port means of the valve block are connected to hydraulic hoses 32, 33 on the working machine, these hydraulic hoses being maneuvered from the driving cabin of the working machine. The ports 19, 20 of the second port means of the valve block are each connected to a female quick-coupling 10 disposed at a displaceable coupling arm 11, wherewith the female quick-couplings 10 can be coupled to male quick-couplings 12 in a coupling block 13 on the tool attachment. The male quick-couplings 12 are connected to the hydraulic cylinder 15 of the tool attachment via hydraulic hoses 14. The ports 21, 22 of the third port means of the valve block are connected to the locking cylinder 7 via the connecting block 8.

The valve block 1 includes a system of lines and valves. A first pair of lines 34, 35 connects the ports 17, 18 with the reversing valve 2. A second pair of lines 36, 37 connects the ports 19, 20 with the reversing valve 2, and a third pair of lines 38, 39 connect the ports 21, 22 with the reversing valve 2.

The line 38 includes a pilot-controlled check valve 4 which is intended to prevent flow from the port 21 to the port 17. Disposed between the line 36 and the line 38 is a connecting line 40 that includes a check valve 6 which is intended to prevent flow from the line 38 to the line 36. A corresponding connecting line 41 that includes a check valve 6 is located between the line 37 and the line 38. Disposed between the line 38 and the line 39 is a connecting line 42 that includes a pressure limiting valve 5. The reversing valve 2 is shown in the Figures in a position in which the ports 17, 18 of the first port means are connected with the ports 19, 20 of the second port means, which is the case when the hydraulics are used for maneuvering of the tool. The reversing valve 2 can be moved to the left in the FIG. by means of the electro magnet 3, to a position in which the ports 18, 17 of the first port means are connected with the ports 21, 22 of the third port means, which is the case when the locking cylinder 7 shall be maneuvered for locking or for releasing the tool. The reversing valve 2 thus enables the hydraulics of the working machine to be used either for releasing the tool or for connecting the tool.

When a switch shall be made from one tool to another, the reversing valve is maneuvered to the position in which the ports 17, 18 are connected with the ports 21, 22. The connection between the hydraulics of the working machine and the hydraulic cylinder 15 of the tool is therewith broken and the connection is made instead to the locking cylinder 7. The line 39 is therewith pressurized, causing the piston rods 30, 31 to move inwards via the lines 26, 27 so as to release the tool from the locking position. The quick couplings 10, 12 are, at the same time, separated from each other owing to the fact that the locking cylinder 7 also controls mechanically the engagement and disengagement of the quick couplings. A fresh working tool is then applied, wherewith the line 38 is pressurized and therewith urges the piston rods outwards to a locking position. At the same time, female quick-couplings 10 are coupled to the male quick-couplings on the fresh tool. The reversing valve 2 is then moved back to the position shown in FIG. 2, for maneuvering the fresh tool. The line 38 is kept pressurized so as to ensure that the locking state remains.

The check valve 4 in the line 38 ensures that the pressure in the line 38 will be sustained, and therewith also the locking effect, even in the event of a hose rupture or a hose malfunction.

The connecting lines 40, 41 and their check valves 6 are intended to post-tension the locking function on the one hand and to relieve the working hydraulics of load prior to engaging and disengaging the working tool. When the reversing valve is in its working hydraulic mode, as illustrated in FIG. 2, the pilot-controlled check valve 4 is blocked. If the pressure in the working hydraulics exceeds the pressure in the line 38 to the locking side of the locking cylinder oil will be subsequently delivered via the check valves 6. Because the system has such a check-valve connection to each of the lines 36, 37 to the working hydraulics, after-supply will take place from the working pressure line 36, 37 that has the highest pressure. This ensures that the tool and the hydraulic couplings 11, 12 will always be in a fully coupled position.

When the reversing valve 2 is set to a position for a tool change, i.e. moved to the left in FIG. 2 would be ports 21, 22 thus connected to the hydraulics of the working machine, any remaining pressure in the hydraulic line 36, 37 will be drained to a tank via the check valves 40, 41. This being due to the fact that the pressure in the lines 36, 37 is higher than the pressure in the line 38 which is then pressure free up to the tank.

The purpose of the pressure limiting valve 5 is to protect the sealing system in the locking cylinder 7 and to enable maneuvering of the reversing valve 2.

What is claimed is:

1. A valve block for use in respect of a tool attachment of a working machine, where the tool attachment is adapted for connection to different kinds of hydraulically operated tools or implements with the aid of a hydraulically actuated locking device, the valve block comprising:

first port means for connection to hydraulic lines of the working machine;

second port means for connection to hydraulic coupling means adapted for coupling to hydraulic coupling elements of the tool or implement; and third port means for connection to the locking device, wherein the valve block also includes a system of lines which communicate with said port means and which include valve means, wherein said valve means are adapted to fulfill at least three of the following functions:

a first function for ensuring the presence of hydraulic pressure in the locking device in the event of a fracture or a leakage in the hydraulic lines of the working machine;

a second function which enables said first port means to be connected selectively to either said second port means or said third port means;

a third function for obtaining post-tensioning of the locking device when the first port means are connected to said second port means;

a fourth function for relieving load prior to connecting and disconnecting the hydraulic connection of the working tool; and a fifth function for achieving pressure limitation of the locking device.

2. The valve block according to claim 1, wherein said valve means are adapted to fulfill at least four of said functions.

3. The valve block according to claim 1, wherein the valve block includes means for fastening the valve block to the locking device.

4. The valve block according to claim 1, wherein the valve means include a first check valve which is intended to provide said first function.

5. The valve block according to claim 1, wherein said valve means include a reversing valve which is adapted to provide said second function.

6. The valve block according claim 5, wherein said reversing valve is maneuvered electro-magnetically.

7. The valve block according to claim 1, wherein said system of lines comprises at least one connecting line which is provided with a check valve and which connects said second port means and said third port means so as to obtain said third and fourth functions.

8. The valve block according to claim 1, wherein said third port means comprises two ports which are each connected to a hydraulic line between which hydraulic lines there is provided a connecting line which includes a pressure limiting valve and which is adapted to provide said fifth function.

9. A tool attachment provided with a valve block according to claim 1.

10. A working machine which includes a tool attachment according to claim 9.

11. The use of a valve block according to claim 1 for connecting and maneuvering a working tool or implement.

* * * * *